United States Patent [19]

DeVries

[11] 4,206,959

[45] Jun. 10, 1980

[54] TERMINAL BOARD WITH INTEGRAL INSULATED POCKET

[75] Inventor: Wayne J. DeVries, St. Louis County, Mo.

[73] Assignee: Emerson Electric Co., St. Louis, Mo.

[21] Appl. No.: 890,199

[22] Filed: Mar. 27, 1978

[51] Int. Cl.[2] ..... H01R 11/02

[52] U.S. Cl. ..... 339/59 R; 310/71

[58] Field of Search ..... 310/71, 194, 184, 198, 310/273, 180, 68 C; 339/36.59 R, 119 R, 119 C; 200/284

[56] References Cited

U.S. PATENT DOCUMENTS

| | | | |
|---|---|---|---|
| Re. 298,822 | 11/1978 | Sheesley | 310/71 |
| 3,293,463 | 12/1966 | Church | 310/71 |
| 3,821,602 | 7/1974 | Linkous | 310/198 |
| 4,034,173 | 7/1977 | Crow | 200/80 R |
| 4,038,574 | 7/1977 | Crow | 310/71 |
| 4,100,444 | 7/1978 | Boyd | 310/184 |
| 4,103,213 | 7/1978 | Landgraf | 310/184 |

FOREIGN PATENT DOCUMENTS

| | | | |
|---|---|---|---|
| 1763353 | 8/1971 | Fed. Rep. of Germany | 310/71 |

*Primary Examiner*—R. Skudy

*Attorney, Agent, or Firm*—Polster, Polster and Lucchesi

[57] ABSTRACT

A terminal connection board finding application with dynamoelectric machines is provided with an integrally formed insulated pocket. In dual voltage motors, final connection of the motor in a particular application is not always determined until the motor is inserted in that application. When motors rated at 115/230 volts are employed in 230 volt source applications, for example, one motor lead is disconnected at the terminal board. The insulated pocket of this invention provides a safe receptacle for that motor lead. Preferably, the pocket includes a locking device for holding the motor lead within the pocket after its insertion.

7 Claims, 4 Drawing Figures

TERMINAL BOARD WITH INTEGRAL INSULATED POCKET

BACKGROUND OF THE INVENTION

This invention relates to terminal board structures for dynamoelectric machines, and in particular to a terminal board structure having an integrally formed insulated pocket for selective reception of a motor lead. While the invention is described with particular reference to its application with single phase induction motors, those skilled in the art will recognize the wider applicability of the inventive principles disclosed hereinafter.

As will be appreciated by those skilled in the art, a number of dynamoelectric machines, for example, capacitor start and split phase induction motors, utilize a first winding combination for the starting conditions of motor operation, and a second winding combination for the run condition of motor operation. It is conventional to employ a centrifugal actuator in these motor types which operates a switch mechanism for connecting or disconnecting a source of electrical energy to various motor winding circuit configurations as motor speed varies. A number of switch assemblies are known in the prior art. A switch assembly with which the invention disclosed hereinafter is particularly suitable is described in the U.S. Pat. to Crow et al, No. 4,034,173, issued July 5, 1977. In Crow et al, a switch operated by a conventional centrifugal actuator is formed as a portion of a terminal board structure. Details of the switch, centrifugal actuator, and motor not disclosed herein are intended to be incorporated by reference to the Crow et al, U.S. Pat. No. 4,034,173.

In general, it is desirable to employ the terminal board and switch structure disclosed in Crow et al with as wide a range of motor constructions as possible. Frequently, the switches are employed with dual voltage motors. A dual voltage motor capability commonly is obtained by altering the interconnections of the motor windings. In dual voltage applications where motors are rated at 115/230 volts, for example, an extra lead is present at the terminal board when the motor is connected for high voltage operation. In the past, the extra lead was insulated through any convenient expedient including common electrically insulative tape and left untethered at the terminal board. The hand insulating procedure required by previously available alternatives is inherently expensive, and the degree of electrical insulation provided often is a matter of conjecture.

The invention disclosed hereinafter overcomes the time consuming hand insulating procedure previously employed and ensures that the motor lead is properly insulated by providing an insulating pocket integrally formed with the terminal board structure. The extra lead available with high voltage motor operation is inserted in that pocket when necessary.

One of the objects of this invention is to provide a terminal board structure having an insulating pocket associated with it.

Another object of this invention is to provide an insulating pocket and terminal board structure in which the insulating pocket is designed to lock a motor lead in position.

Another object of this invention is to provide a safe electrically insulated structure for reception of a motor lead.

Other objects of this invention will be apparent to those skilled in the art in light of the following description and accompanying drawing.

SUMMARY OF THE INVENTION

In accordance with this invention, generally stated, a terminal connection board finding application as an interface between a dynamoelectric machine and a source of electrical energy has an insulated connection pocket integrally formed with it. The pocket includes a wall structure arranged to enclose and hold an electrical connector in an electrically and mechanically safe position during dynamoelectric machine operation.

DESCRIPTION OF THE PREFERRED EMBODIMENT

Figure 1:
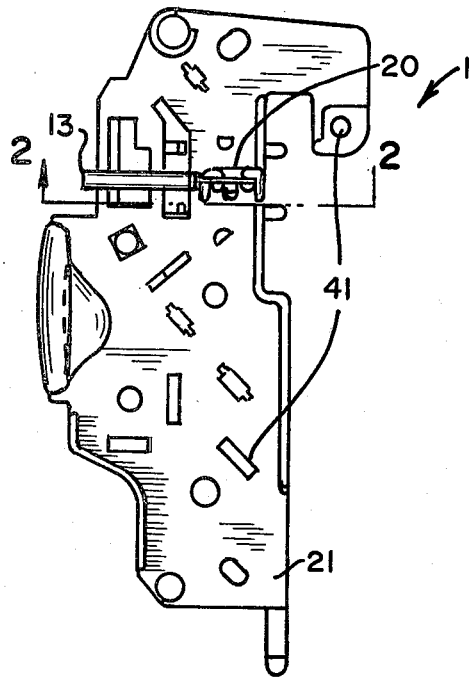
FIG. 1 is a plan view of one illustrative embodiment of terminal board structure employing the insulated pocket of this invention.

Referring now to FIG. 1, reference numeral 1 indicates a terminal board and a switch structure employing my invention. The terminal board and switch structure is similar to that described in Crow et al, U.S. Pat. No. 4,034,173, and construction details disclosed in the Crow et al reference are intended to be incorporated by reference. The switch structure 1 finds application with a dynamoelectric machine of the induction motor type, for example, denominated by the reference numeral 2 and shown diagrammatically in FIGS. 3 and 4 as discussed in Crow et al, the terminal board includes a first face, a second face, a lower edge, and an upper edge.

As shown in those last mentioned Figures, the motor 2 includes a first main winding 3, a second main winding 4 and an auxiliary winding 5. In general, the windings 3, 4 and 5 are arranged in a core of magnetic material, not shown, which has a plurality of slots formed in the core for accomodating the windings. Although indicated as single coils in FIGS. 3 and 4, each of the windings in practice comprises a plurality of coil sets constructed from individual turns of magnet wire. The winding turns are distributed in the slots of the core in some predetermined manner. A capacitor 6 is connected in series with the auxiliary winding 5 in the particular motor 2 described. Other induction motor types not utilizing capacitors in the motor circuit and motors other than induction types are compatible with the invention disclosed hereinafter.

Figure 3:
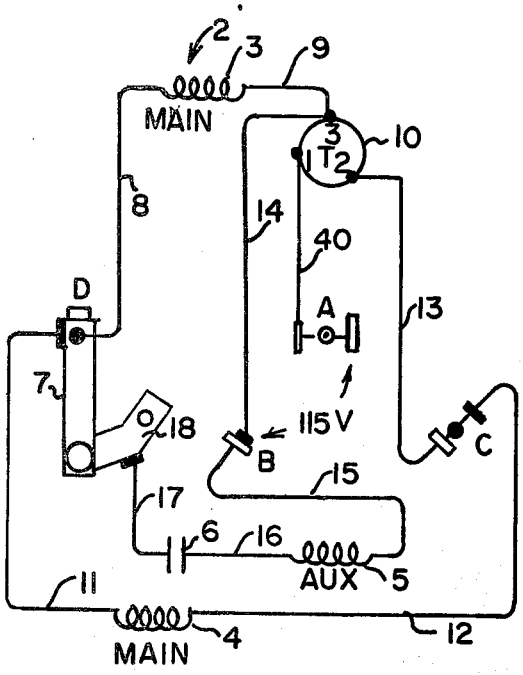
FIG. 3 is a diagrammatic view of a dual voltage motor showing the electrical connections employed for low voltage operation.
Figure 4:
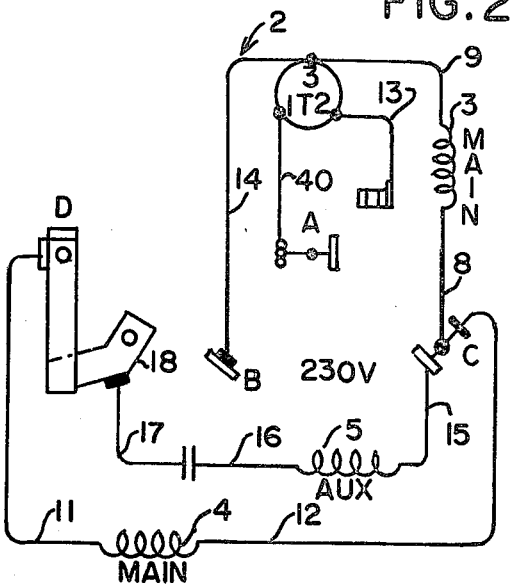
FIG. 4 is a diagrammatic view of the dual voltage motor depicted in FIG. 3, illustrating the high voltage operation connection therefor.

The terminal board 1 has a plurality of electrical connectors mounted to it, indicated in FIGS. 3 and 4 by the letter designations A, B, C and D. A plurality of openings 41 are arranged along the terminal board 1 and are adapted to receive the connectors A–D in a conventional manner. The location of the connectors A–D on the terminal board 1 may vary in embodiments of this invention. A switch arm 7 is movably mounted to the terminal board 1. The switch arm 7 is actuated by a suitable centrifugal actuator (not shown) to connect and disconnect the auxiliary winding 5 and capacitor 6 from the motor circuit.

In general, the main windings 3 and 4 are connected in parallel for 115 volt operation, and in series for 230 volt operation. In the 115 volt connection arrangement shown in FIG. 3, a first end of the main winding 3 is connected to the terminal D of the terminal board 1 by a motor lead 8. A second end of the main winding 3 is connected to a terminal T3 of a motor protector 10 by a motor lead 9. The protector 10 is conventional and a variety of protector devices are available commercially. A motor lead 11 connects one side of the main winding 4 to the terminal D of the terminal board 1, while a motor lead 12 connects the other side of the main winding 4 to the terminal C. An electrical conductor or lead 13 is connected between the terminal C of the board 1 and a terminal T2 of the protector 10. A terminal T1 of the protector 10 is connected to the terminal board 1 terminal A by a conductor or lead 40. A conductor or lead 14 is electrically connected between the protector 10 terminal T3 and the terminal board 1 terminal B. In applicational use, the terminal A of the terminal board 1 is connected to a source of electrical energy, not shown. Terminal board 1 terminal D also is electrically connected to a source of electrical energy, not shown.

An auxiliary winding motor lead 15 is connected between the terminal B and a first side of the auxiliary winding 5. As indicated above, a motor lead 16 is connected between a second side of the auxiliary winding 5 and one side of the capacitor 6, while an electrical conductor or lead 17 is connected from the second side of the capacitor 6 to a conductor 18. The conductor 18 is engaged by the switch arm 7 in the "off" position of the motor 1. As thus described, the main windings 3 an 4 are connected in parallel across the source of electrical energy, and are protected against motor overload considerations by the protector 10.

For 230 volt operation, the motor lead 15 is electrically connected to the terminal board terminal C. The motor lead 8 is also connected to the switch terminal C and the motor lead 13 is free of any electrical connection. In order to prevent motor lead 13 interference with motor 2 operation, I provide an insulated pocket 20.

Figure 2:
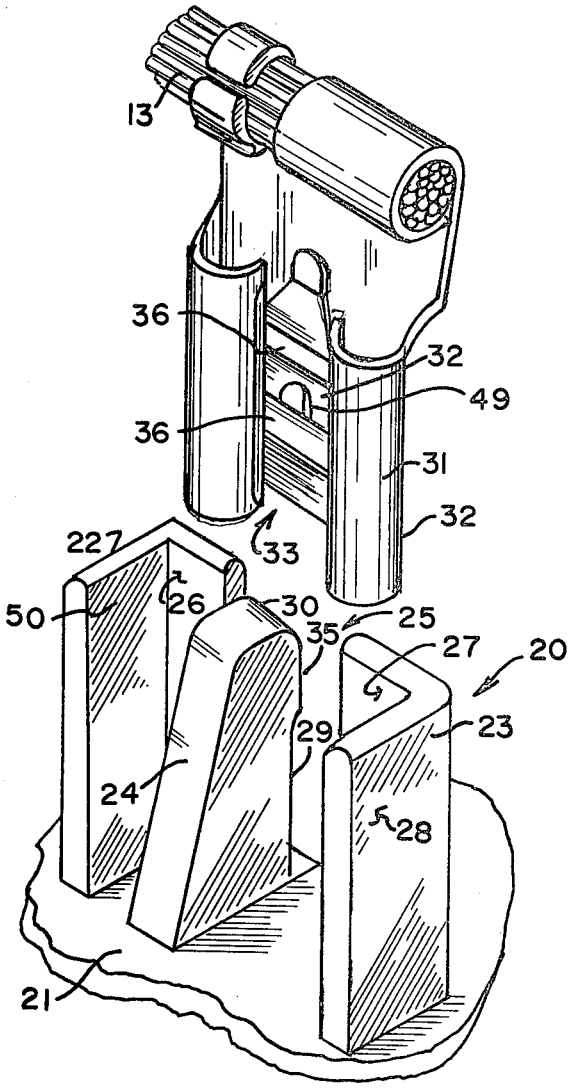
FIG. 2 is an enlarged view in perspective, partly broken away, taken about the line 2—2 showing the insulated pocket employed with the terminal board of FIG. 1.

The pocket 20, best seen in FIGS. 1 and 2, is integrally formed along a side 21 of the terminal board and switch structure 1. In the embodiment illustrated, the pocket 20 includes a first wall structure 22, a second wall structure 23, and a tab 24. The wall structures 22 and 23 are similar, and are oppositely opposed to and spaced from one another so as to define a gap 25. The wall structure 22 includes a pair of surfaces 50 and 26, respectively, positioned at right angles to one another and extending outwardly of the side 21 of the terminal board 1. The wall structure 23 likewise includes a surface 27 and a surface 28 positioned at right angles to one another and extending outwardly from the side 21.

Tab 24 has a front wall 29 which, together with the wall structures 22 and 23, delimit a receptacle 30. The receptacle 30 is designed to receive an electrical connector 31 which terminates the conductor 13. The connector 31 is attached to the conductor 13 in a conventional manner.

Connector 31 may comprise any of a variety of commercially available products and includes a generally planar surface 32 having edges which are rolled to define a receiver 33. The wall 29 of the tab 24 has a projection 35 integrally formed with it, which extends inwardly of the receptacle 30. The width of the wall 29 and projection 35 are designed so that at least the projection 35 enters the receiver 33 of the connector 31 in the inserted position of the connector 31. Conventionally, the surface 32 of the connector 31 has a series of slots 36 formed in it. The slots 36 divide the surface 32 into a series of strip like areas 34. At least one of the areas 34 has a retention tab 49 integrally formed with it, tab 49 being formed so that it extends inwardly of the receiver 33. The projection 35 of the tab 24 is positioned to engage the retention tab 49 in the inserted position of the connector 31. That engagement locks the connector 31 within the receptacle 30 of the pocket 20, preventing inadvertant removal of the connector. The tab 24, however, is designed with sufficient flexibility so that it may be deflected slightly to permit the intentional removal of the connector 31.

In operation, use of the pocket 20 is relatively simple. When 230 volt application is desired, the connector 31 of the conductor 13 merely is removed from its interconnection with the switch terminal C and inserted within the pocket 20 where it is insulated from the surrounding structure and from the motor 2. That insertion prevents conductor 13 interference with motor or switch operation.

Numerous variations, within the scope of the appended claims, will be apparent to those skilled in the art in light of the preceding description and accompanying drawings. Thus, the particular design silhouette of the pocket 20 may vary in other embodiments of this invention. I find that the spaced structural components delimiting the receiver 30 described above offer cost advantages in construction. However, other structural designs and design silhouettes are compatible with the broader aspects of the invention. In like manner, the design silhouette of the terminal board with which the pocket 20 finds application, may be changed. These variations are merely illustrative.

Having thus described the invention, what is claimed and desired to be secured by Letters Patent is:

1. In a terminal board for connecting a source of power to a dynamoelectric machine, said dynamoelectric machine including at least a first main winding, a second main winding, and an auxiliary winding, said terminal board including first and second faces having a material thickness therebetween, means for connecting said power source to said windings, and a plurality of electrical conductors for operatively connecting said winding to said teminal board, at least one of said conductors being terminated in an electrical quick connect connector, the improvement comprising an insulating pocket of nonconductive material integrally formed with said terminal board, said pocket being defined by a first wall structure, a second wall structure spaced from said first wall structure, and means for releasably locking said quick connect connector in said pocket, said locking means being spaced from said first and said second wall structures so as to have a gap therebetween, said first, second, and releasably locking means extending outwardly from one of said first and second faces of said terminal board, said last mentioned terminal board face defining a closed bottom for said pocket.

2. The improvement of claim 1 wherein said quick connect connector includes a generally planer surface having a first edge and a second edge folder over and positioned to define a receiver between said folded edges, the first wall structure of said insulating pocket abutting said first edge, the second wall structure of said insulating pocket abutting said second edge, said releasably locking means entering the receiver defined by the first and second folded edges of said connector.

3. The improvement of claim 2 wherein said locking means comprises a tab which frictionally engages said connector.

4. In a terminal board for connecting a source of electrical energy to a dynamoelectric machine said dynamoelectric machine including at least a first main winding and an auxiliary winding, said terminal board having a first side surface and a second side surface separated by a material thickness, said first side surface defining a connection side and said second side surface defining a switch side for said terminal board, and a plurality of electrical conductors for operatively connecting said windings to said terminal board, at least one of said conductors being terminated in an electrical quick connect connector, the improvement comprising an insulatng pocket of nonconductive material mounted to the connection side of said terminal board and extending outwardly therefrom, said insulating pocket being formed by a predeterminedly arranged wall structure, the components of which are spaced from one another so as to have a gaps therebetween, and adapted to receive at least one of said electrical quick connect connectors, and means for releasably locking said connector in said pocket, said last mentioned means delimiting a portion of said insulating pocket, the connection side of said terminal board defining a closed bottom for said pocket.

5. The improvement of claim 4 wherein said quick connect connector includes a generally planer surface having a first edge and a second edge folded over and positioned to define a receiver between said folded edges, said predeterminedly arranged wall structure including a first wall structure, as second wall structure, and a locking means, the first wall structure of said insulating pocket abutting said second edge, said releasably locking means entering the receiver defined by the first and second folded edges of said connector.

6. The improvement of claim 5 wherein said locking means comprises a tab which frictionally engages said quick connect connector.

7. The improvement of claim 6 wherein each of said first and second wall structures of said insulating pocket includes first and second surfaces arranged perpendicularly to one another.

* * * * *